US008820539B1

(12) United States Patent
Currey

(10) Patent No.: US 8,820,539 B1
(45) Date of Patent: Sep. 2, 2014

(54) CRUSHER AND MECHANICAL BUCKET FOR USE THEREWITH

(71) Applicant: Albert Ben Currey, Phoenix, AZ (US)

(72) Inventor: Albert Ben Currey, Phoenix, AZ (US)

( * ) Notice: Subject to any disclaimer, the term of this patent is extended or adjusted under 35 U.S.C. 154(b) by 0 days.

(21) Appl. No.: 13/751,895

(22) Filed: Jan. 28, 2013

Related U.S. Application Data

(63) Continuation of application No. 12/820,771, filed on Jun. 22, 2010, now Pat. No. 8,360,249, which is a continuation-in-part of application No. 12/426,045, filed on Apr. 17, 2009, now Pat. No. 8,231,011, which is a continuation of application No. 11/832,450, filed on Aug. 1, 2007, now Pat. No. 7,549,544, which is a continuation-in-part of application No. 11/562,864, filed on Nov. 22, 2006, now Pat. No. 7,445,122.

(51) Int. Cl.
*B07B 13/00* (2006.01)
*B02C 23/16* (2006.01)

(52) U.S. Cl.
CPC ..... *B02C 23/16* (2013.01)
USPC ..... 209/672; 209/3; 241/101.72; 241/189.1

(58) Field of Classification Search
USPC ..... 209/659, 660, 671, 672, 674
See application file for complete search history.

(56) References Cited

U.S. PATENT DOCUMENTS

| | | | | |
|---|---|---|---|---|
| 5,887,810 | A * | 3/1999 | Maruyama | 241/189.1 |
| 6,237,865 | B1 * | 5/2001 | Luttermann et al. | 241/101.72 |
| 6,371,305 | B1 * | 4/2002 | Austin et al. | 209/672 |
| 7,182,204 | B2 * | 2/2007 | Schenk | 209/3 |
| 2004/0050984 | A1 * | 3/2004 | Rossi, Jr. | 241/101.72 |
| 2004/0050987 | A1 * | 3/2004 | Rossi, Jr. | 241/101.77 |
| 2006/0242864 | A1 * | 11/2006 | Jonninen | 37/433 |

* cited by examiner

*Primary Examiner* — Terrell Matthews
(74) *Attorney, Agent, or Firm* — Schmesier, Olsen & Watts LLP

(57) ABSTRACT

A motor driven crusher for agitating and crushing material is provided. The crusher includes a frame removably coupled to a mechanical bucket and a plurality of shafts rotatably coupled within the frame and operationally coupled to the motor. The crusher further includes a plurality of crushing agitators coupled to each shaft of the plurality of shafts; and a plurality of screening spaces each having a predetermined spacing, wherein material placed on a top side of the crusher is agitated and crushed by the plurality of crushing agitators while the plurality of shafts rotate, screening small material through the plurality of screening spaces while crushing the larger material on the top side of the crusher to fit within the plurality of screening spaces.

11 Claims, 15 Drawing Sheets

CRUSHER AND MECHANICAL BUCKET FOR USE THEREWITH

CROSS REFERENCE TO RELATED APPLICATION

This application is a continuation of the earlier U.S. Utility Patent Application entitled "CRUSHER AND MECHANICAL BUCKET FOR USE THEREWITH," Ser. No. 12/820,771, filed Jun. 22, 2010, which is a continuation-in-part of the earlier U.S. Utility Patent Application entitled "AGITATOR AND MECHANICAL BUCKET FOR USE THEREWITH," Ser. No. 12/426,045, filed Apr. 17, 2009, which is a continuation of the earlier U.S. Utility Patent Application entitled "AGITATOR AND MECHANICAL BUCKET FOR USE THEREWITH," Ser. No. 11/832,450, filed Aug. 1, 2007, which is a continuation-in-part of the earlier U.S. Utility Patent Application entitled "MECHANICAL BUCKET," Ser. No. 11/562,864, filed Nov. 22, 2006, the disclosures of which are hereby incorporated entirely herein by reference.

BACKGROUND OF THE INVENTION

1. Technical Field

This invention relates generally to an agitator and mechanical bucket and more particularly to an agitator with scalping agitators and/or solid shaft configurations and a mechanical bucket for use therewith that separates smaller material from larger material.

2. State of the Art

The separation of smaller material from larger material is common in instances such as excavation wherein the smaller material is desired at one location and the larger material is desired to be at a second location. This is commonly performed in a process that requires several steps to complete.

For example, a vehicle such as, but not limited to a hydraulic excavator, backhoe or loader applications, may use a bucket or other device to collect a particular amount of material. The material may be deposited into a separating device, such as a screen or disc screen separator. The smaller material is separated from the larger material. The smaller material may then be transported to a first location and the larger material may be transported to a second location. There are several limitations to these common or conventional forms of separating smaller material from larger material.

One limitation includes having multiple pieces of equipment to perform the separation of the material. A vehicle is required to collect the material. A separating device then separates the smaller material from the larger material. A vehicle may be employed to deliver the smaller material to a first location and another vehicle may be employed to deliver the larger material to second location. This creates a time consuming process of separating material.

Another limitation is present when debris collects or becomes lodged in particular components of a separating device and hinders proper functionality of the separating device. For example, in a disc screen or roller screen separator, debris may hinder the rotation of the discs or rollers that perform the separating of the smaller material from the larger material. This is due in part to the configuration of the roller screen and further to distance between roller shafts within the screen. They are close and the screening area is smaller, thereby allowing the debris to collect in these small areas. The removal of the debris requires additional equipment to dislodge and/or remove the debris to allow proper functionality of the separating device to properly perform separation of material.

Further still another limitation of roller screens is the screening spaces. Referring to the drawings, FIG. 12 is a drawing of a prior art roller screen configuration. The roller screen configuration includes screening spaces 170. Each of the screening spaces 170 is defined as the space bounded by each shaft 172 on opposing sides and between discs 174 and 176 on the other opposing sides. The screening spaces 170 are very small and limited to certain applications and material sizes.

Accordingly, there is a need for an improved separating device that requires less equipment and has the ability to remove debris from the separating device.

DISCLOSURE OF THE INVENTION

The present invention relates to a crusher used for agitating and crushing material and a mechanical bucket for use with configurations of the agitator.

An aspect includes a motor driven crusher for crushing material, the crusher comprises a frame removably coupled to a mechanical bucket; a plurality of shafts rotatably coupled within the frame and operationally coupled to the motor, wherein axes of the plurality of shafts are substantially parallel; a plurality of crushing agitators coupled to each shaft of the plurality of shafts; and a plurality of screening spaces each having a predetermined spacing, each spacing of the plurality of screening spaces defined between sides of adjacent crushing agitators of one shaft, an edge of the one shaft and an edge of a crushing agitator of an adjacent shaft, wherein material placed on a top side of the crusher is agitated and crushed by the plurality of crushing agitators while the plurality of shafts rotate, screening small material through the plurality of screening spaces while crushing the larger material on the top side of the crusher to fit within the plurality of screening spaces.

Another aspect includes a material agitating and crushing apparatus comprising an excavator including a mechanical bucket comprising a motor driven crusher. The motor driven crusher comprises a frame removably coupled to a mechanical bucket; a plurality of shafts rotatably coupled within the frame and operationally coupled to the motor, wherein axes of the plurality of shafts are substantially parallel; a plurality of crushing agitators coupled to each shaft of the plurality of shafts; and a plurality of screening spaces each having a predetermined spacing, each spacing of the plurality of screening spaces defined between sides of adjacent crushing agitators of one shaft, an edge of the one shaft and an edge of a crushing agitator of an adjacent shaft, wherein material placed on a top side of the crusher is agitated and crushed by the plurality of crushing agitators while the plurality of shafts rotate, screening small material through the plurality of screening spaces while crushing the larger material on the top side of the crusher to fit within the plurality of screening spaces.

The foregoing and other features and advantages of the present invention will be apparent from the following more detailed description of the particular embodiments of the invention, as illustrated in the accompanying drawings.

DETAILED DESCRIPTION OF EMBODIMENTS OF THE INVENTION

As discussed above, embodiments of the present invention relate to an agitator used for agitating and separating material and a mechanical bucket for use with configurations of the agitator. Generally the agitator comprises a shaft with a plurality of scalping agitators coupled to the shaft.

Figure 1:
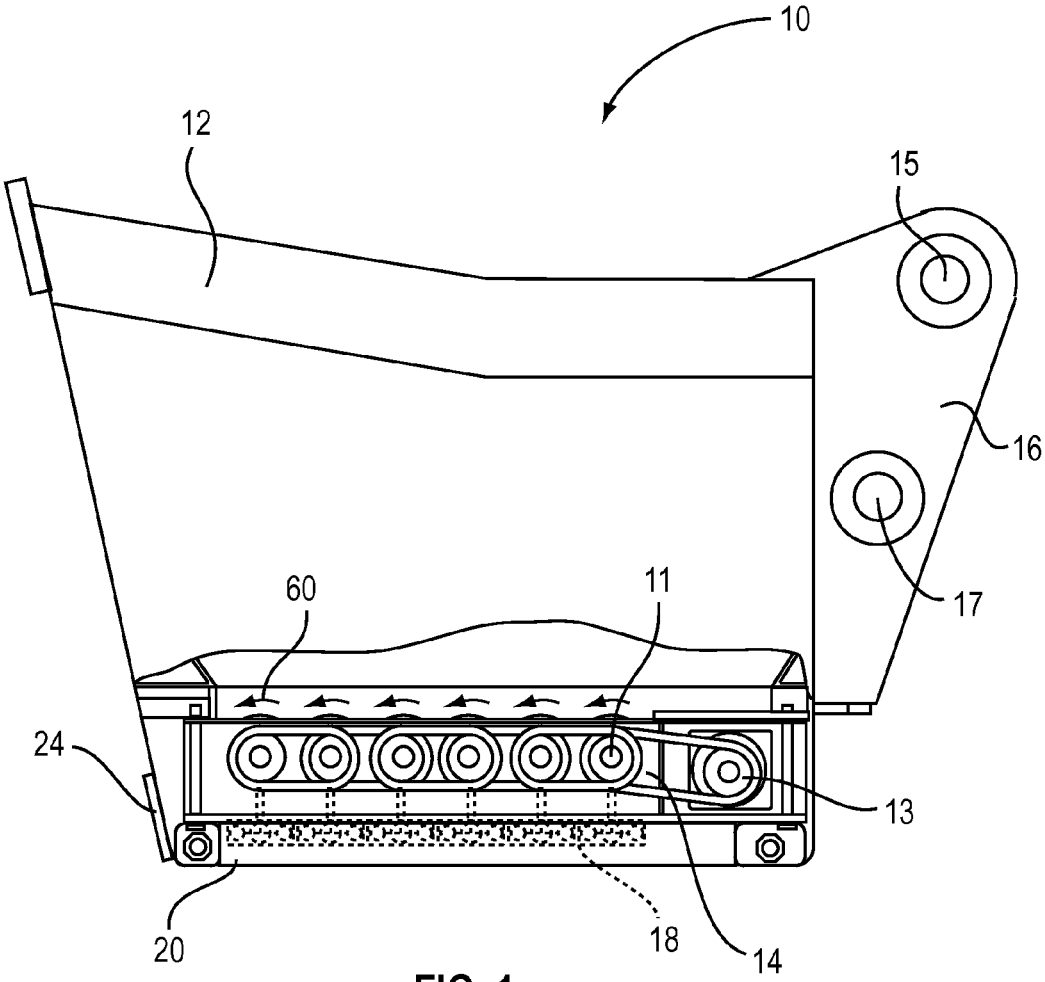
FIG. 1 is a side view with a cut away portion of a mechanical bucket in accordance with particular embodiments of the present invention.
Figure 2:
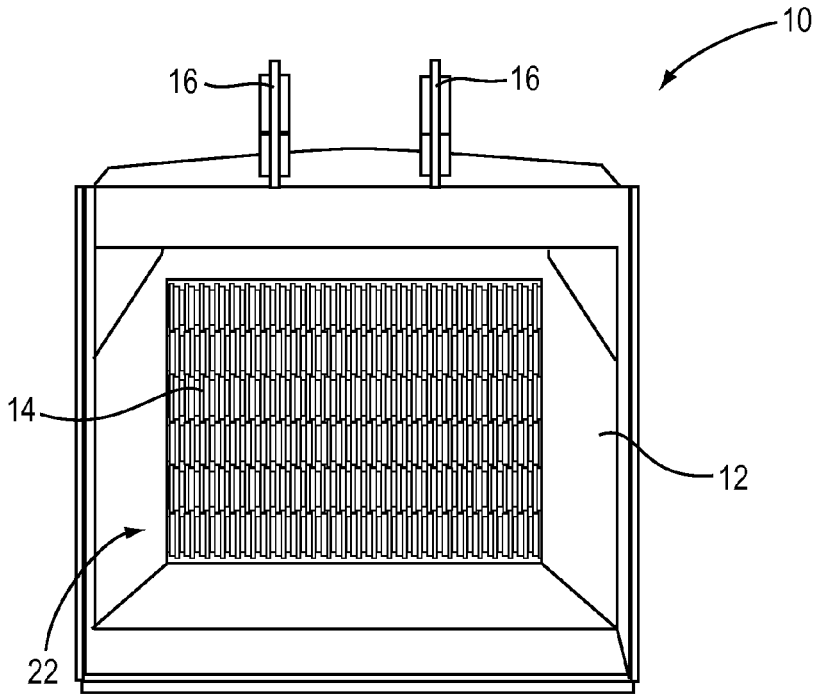
FIG. 2 is a top view of a mechanical bucket in accordance with the present invention.
Figure 3:
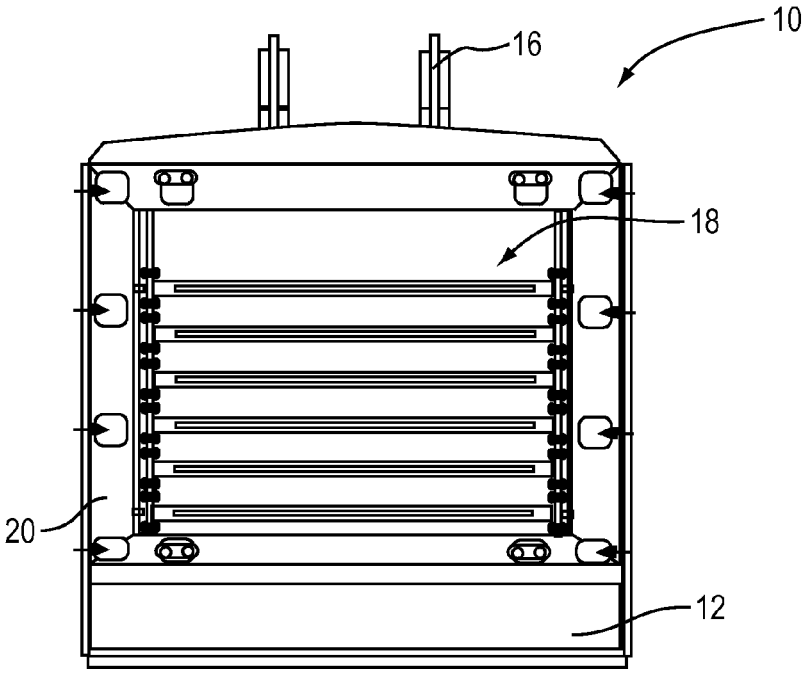
FIG. 3 is a bottom view of a mechanical bucket in accordance with the present invention.

Referring to the drawings, FIGS. 1-3, depict a mechanical bucket 10 in accordance with particular embodiments of the present invention. The mechanical bucket 10 includes a bucket 12, a disc assembly 14 and a sub-base 20. The disc assembly is removably secured to a bottom portion 24 of the bucket 12. In particular embodiments of the present invention, the sub-base 20 is coupled to the bottom portion 24 of the bucket 12, wherein the sub-base 20 removably secures the disc assembly 14 to the bottom portion 24 of the bucket 12. The bucket 12 further includes mounting ears 16. The mounting ears 16 comprise mounting apertures 15, 17 for mounting to a vehicle, such as, but not limited to, a hydraulic excavator and/or backhoe.

Particular embodiments of the mechanical bucket 10, in accordance with the present invention, may include a scraper device 18. The scraper device 18 is coupled adjacent the disc assembly 14. The sub-base 20 may couple the scraper device 18 adjacent the disc assembly 14. The scraper device 18 is used to remove debris from the disc assembly 14.

The bucket 12 includes an opening 22 for receiving material within the bucket 12. The material rests on the disc assembly 14 without any substantial portion of the material falling through the disc assembly 14 when the disc assembly is deactivated. Upon activation of the disc assembly 14, the disc assembly is adapted to allow smaller material to be separated from larger material. The activation of the disc assembly 14 agitates the material and allows smaller material to pass through the disc assembly 14 while the larger material remains within the bucket 12, resting on the disc assembly 14.

It will be understood that various types of disc assemblies may be used with the mechanical bucket 10. The rollers of the disc assembly may have discs of any shape and size. For example and without limitation, the shape of the discs may be round, triangular, circular, oval, square, rectangular, an ogive, a star and any other shape usable within a disc assembly 14. The disc assembly may further allow for various sized material to pass through the disc assembly 14, while still separating the larger material from the smaller material, thereby allowing various sizes of material to pass through while still restricting the material greater that the desired sized of material from passing through the disc assembly 14.

In particular embodiments of the present invention, the mechanical bucket 10 may activate the disc assembly 14 at variable revolutions per minute (RPM) or at a variable rotational speed. This allows the various types of disc assemblies to be used with the mechanical bucket 10 wherein the RPM may be adjusted for reasons including, but not limited to the types of discs being used on the rollers and the material to be separated. Additionally, the disc assembly 14 when activated gradually reaches operating speed and when deactivated gradually reaches stopping speed. For example, the disc assembly 14 may be driven to its operating speed at a predetermined rate when activated and may further be driven from operating speed to a stop at a predetermined rate when deactivated. This gradual increase and decrease in speed of the disc assembly provides for less wear on the disc assembly 14, thereby prolonging the life of the disc assembly 14 and reducing the frequency of repairs and replacements of the disc assembly 14.

Figure 4A:
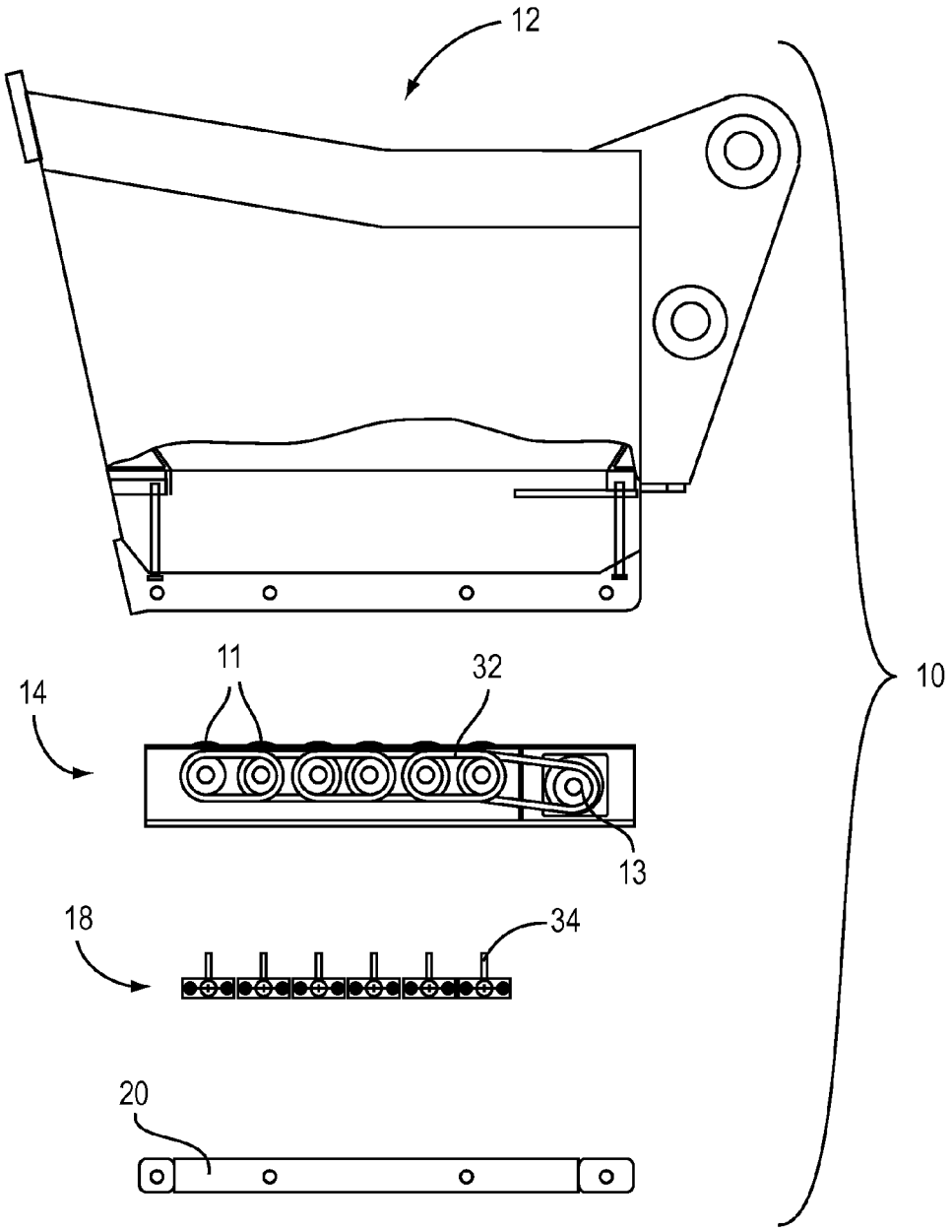
FIG. 4A is a side exploded view of a the mechanical bucket of FIG. 1 in accordance with particular embodiments of the present invention.
Figure 4B:
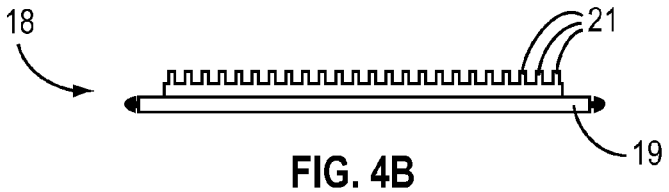
FIG. 4B is a front view of scraper device in accordance with particular embodiments of the present invention.

Referring again to the drawings, FIGS. 4A and 4B depict an exploded view of a mechanical bucket 10 and a front view of a scraper device 18 respectively. The mechanical bucket in accordance with particular embodiments of the present invention includes a bucket 12, a disc assembly 14, and a sub-base 20, and may include a scraper device 18. The roller assembly may include a plurality of rollers 11, a motor 13 and a plurality of chains 32 driving the disc assembly 14 when activated. The plurality of rollers 11 are adapted to rotate in a same direction 60 (See FIG. 1) when the disc assembly 14 is activated by the motor 13 and chains 32. The motor 13 may be adapted to gradually bring the disc assembly 14 to operating speed upon activation and to gradually bring the disc assembly 14 to a stop upon deactivation. Further, the motor 13 may operate the disc assembly 14 at variable revolutions per minute.

The scraper device 18 may include a plurality of scrapers 34 coupled within the scraper device 18, wherein the number of scrapers 34 corresponds to the number of rollers 11. A scraper 34 includes a base portion 19 and a plurality of extensions 21. The extensions 21 extend in a direction transverse to the base portion 19. The plurality of extensions 21 engages the disc assembly 14 to scrape debris from the disc assembly 14. It will be understood by those of ordinary skill in the art that various types of scraper devices may be employed, so long as they remove debris from the disc assembly.

Figure 5A:
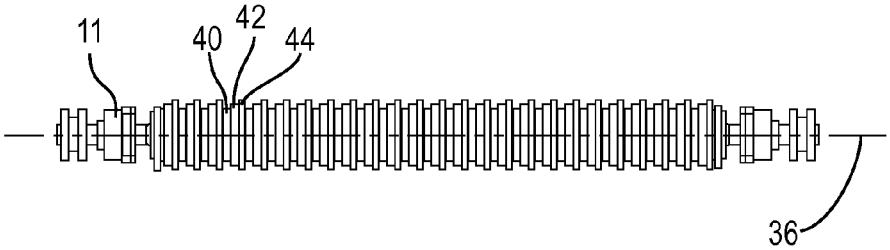
FIG. 5A is a side view of a roller of a disc assembly in accordance with the present invention.

Referring further to the drawings, FIG. 5A depicts a roller 11 of the roller assembly 14, in accordance with embodiments of the present invention. The roller 11 includes a plurality of portions 40, 42, 44, each portion having one of a first radius (portion 40), a second radius (portion 42) and a third radius (portion 44). The first radius is smaller than the second radius and the second radius is smaller than the third radius. Each portion 40, 42, 44 of the rollers are coupled together in a repeating pattern for a predetermined length. The pattern includes a portion having the first radius (portion 40) coupled to a portion having the second radius (portion 42), the portion having the second radius (portion 42) coupled to a portion having the third radius (portion 44), and the portion having the third radius (portion 44) coupled to another portion having the first radius (portion 40). It will be understood that while a particular pattern is shown in FIG. 5A, other patterns may be implemented while providing the same or substantially the same benefit and functionality.

Figure 5B:
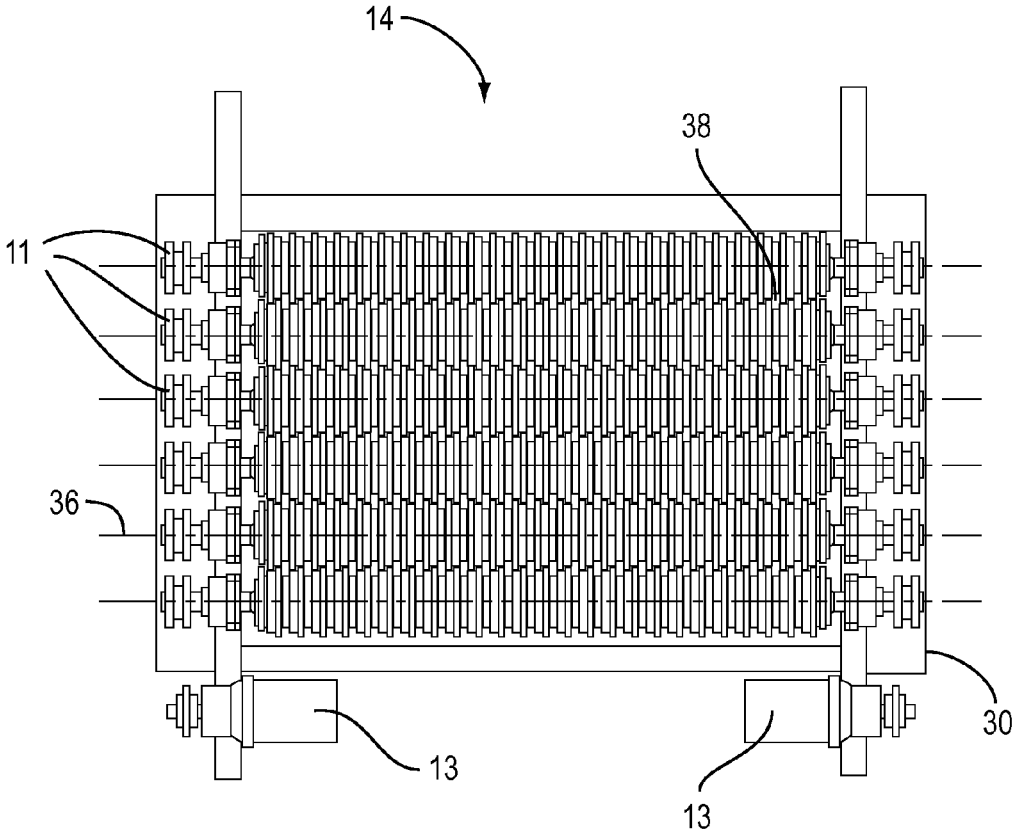
FIG. 5B is a top view of a disc assembly in accordance with the present invention.

With additional reference to FIG. 5B, each roller 11 has an axis 36. A plurality of rollers 11 are coupled together within the disc assembly 14. The axes 36 of the plurality of rollers 11 in the disc assembly 14 are substantially parallel within substantially a same plane. Further, the plurality of rollers 11 of the disc assembly 14 are coupled adjacent each other and are oriented in opposite directions such that portions having the first radius (portion 40) are adjacent each other defining a gap 38 of a predetermined size and portions having the second radius (portion 42) are adjacent portions having the third radius (portion 44). This allows for only material having a size smaller than the gap 38 between the portions having the first radius (portion 40) to pass through the disc assembly 14, thereby separating the smaller material from the larger material. The separation is performed by activating a motor 13 and thereby turning the rollers 11 in the same direction 60 (See FIG. 1), such that material is agitated allowing the smaller material to pass through the disc assembly 14 while retaining the larger material on the disc assembly 14. Once the material is separated, the motor 13 is deactivated thereby deactivating the disc assembly 14. Particular embodiments of the present invention include chain guards 30 to protect the chains 32 (FIG. 5B) of the disc assembly 14.

Figure 6:
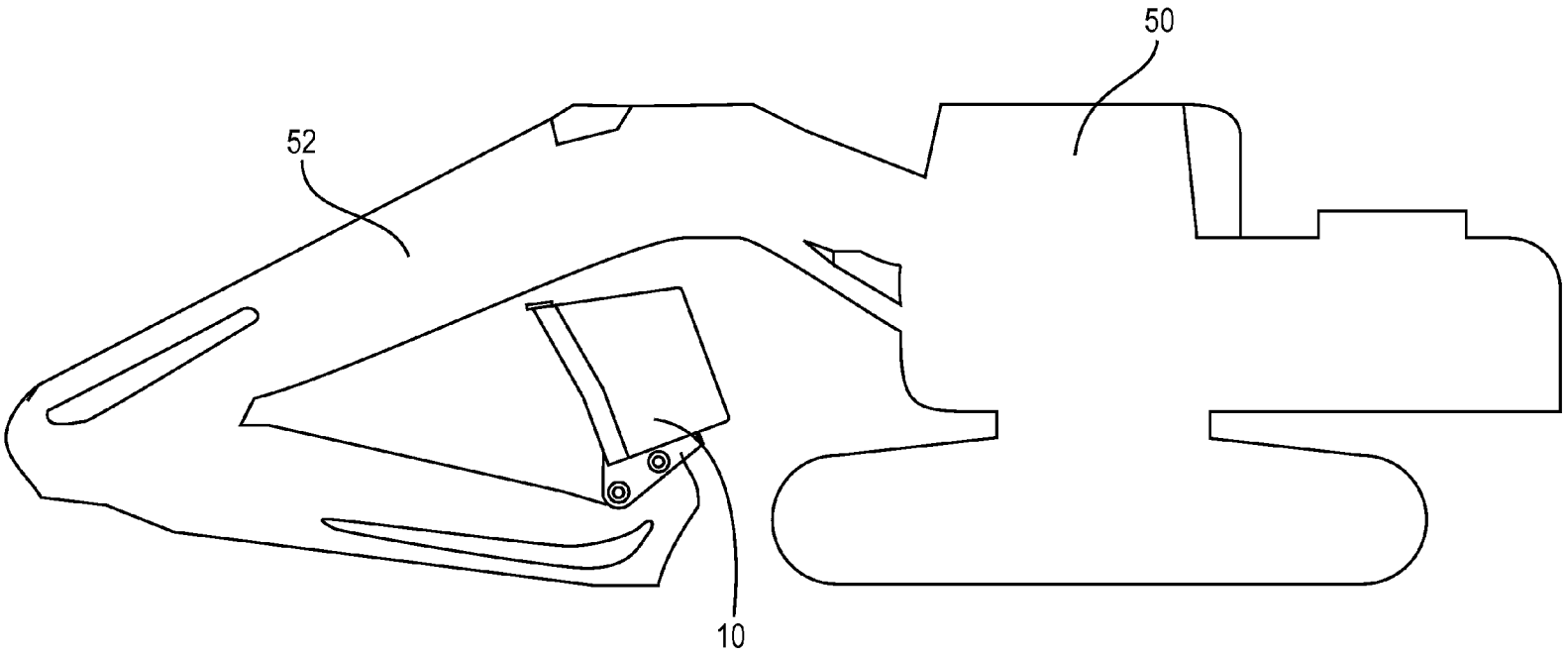
FIG. 6 is a side view of a vehicle with a mechanical bucket in accordance with the present invention.

As shown in FIG. 6, particular embodiments may include a material separator comprising a mechanical bucket 10 that is adapted to couple to a vehicle 50 in accordance with the present invention. The mechanical bucket 10 may be coupled to an arm 52 of the vehicle 50. The vehicle 50 may be any type of vehicle, including but not limited to, a hydraulic excavator and a backhoe. The vehicle 50 may utilize the mechanical bucket 10 in a typical manner to scoop or otherwise receive material within the mechanical bucket 10. The mechanical bucket 10 may then be moved to a first location where it is desired that material of smaller size is to be deposited. The mechanical bucket 10 is then activated to separate the smaller material from the larger material, the smaller material passing through the disc of the mechanical bucket 10 and is deposited in the first location. Once the separating is completed, the vehicle 50 moves the mechanical bucket 10 to a second location for depositing the larger material by dumping it out of the mechanical bucket 10 in a typical dumping fashion by rotating the mechanical bucket 10. The present invention allows for the separation of material with a single piece of equipment, increasing efficiency.

It will be understood that various sizes of mechanical buckets may be employed dependent on various factors such as, but not limited to, the amount of material to be separated and/or the size of the vehicle. Further, the disc assembly may also be of various sizes and include various amounts of the plurality of rollers, wherein the roller assembly is comparable to the size of the mechanical bucket.

While FIGS. 1-6 depict one particular embodiment of a disc assembly for use with a mechanical bucket, FIGS. 7-11C are directed at other embodiments of the present invention. These embodiments are directed at an agitator and a mechanical bucket for use with the agitator.

Figure 7:
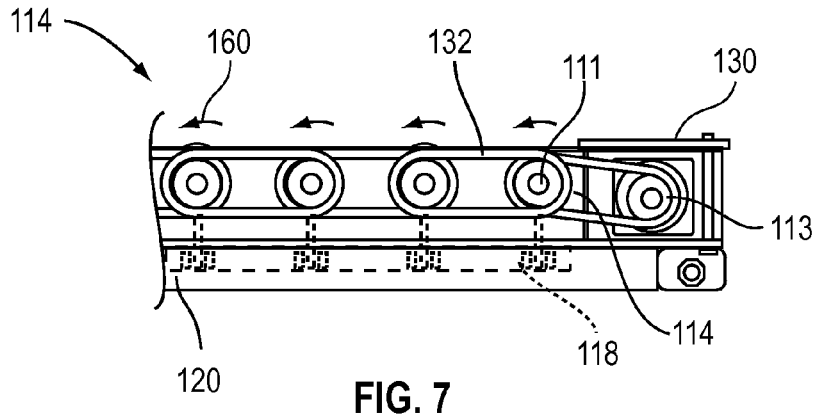
FIG. 7 is a side view of an agitator in accordance with the present invention.

Referring to the drawings, FIG. 7 depicts an agitator 114 in accordance with particular embodiments of the present invention. The agitator 114 may comprise a frame 130, a base 120, a plurality of shafts 111, a motor 113 and a plurality of chains 132 driving the agitator 114 when activated. The plurality of shafts 111 are adapted to rotate in a same direction 160 when the agitator 114 is activated by the motor 113 and chains 132. It will be understood that the plurality of shafts 111 can rotate in either direction dependant upon the direction of rotation of the motor 113. The motor 113 may be adapted to gradually bring the agitator 114 to operating speed upon activation and to gradually bring the agitator 114 to a stop upon deactivation. Further, the motor 113 may operate the agitator 114 at variable revolutions per minute. The agitator 114 may further comprise a scraper 118 for cleaning debris from the agitator 114.

Figure 8A:
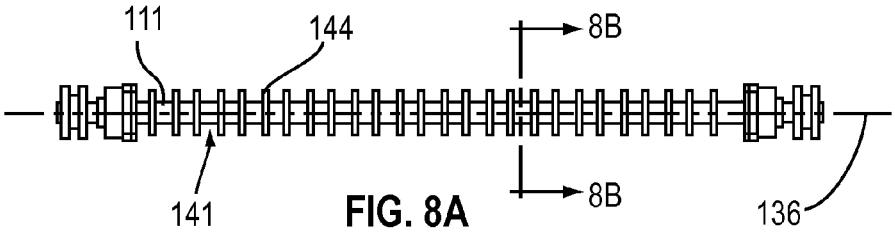
FIG. 8A is side view of a shaft of an agitator in accordance with the present invention.
Figure 8B:
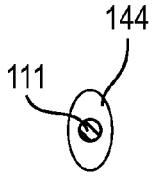
FIG. 8B is a section view taken along line 8B-8B of FIG. 8A of a shaft of an agitator in accordance with the present invention.

Referring further to the drawings, FIG. 8A depicts a shaft 111 of the agitator 114, in accordance with embodiments of the present invention. The shaft 111 comprises a plurality of scalping agitators 144 coupled to the shaft 111 at substantially evenly spaced intervals. The shaft 111 further comprises a plurality of cleaning areas 141 between each of the scalping agitators 144. The cleaning areas 141 are areas where debris may build up and require cleaning.

Figure 8C:
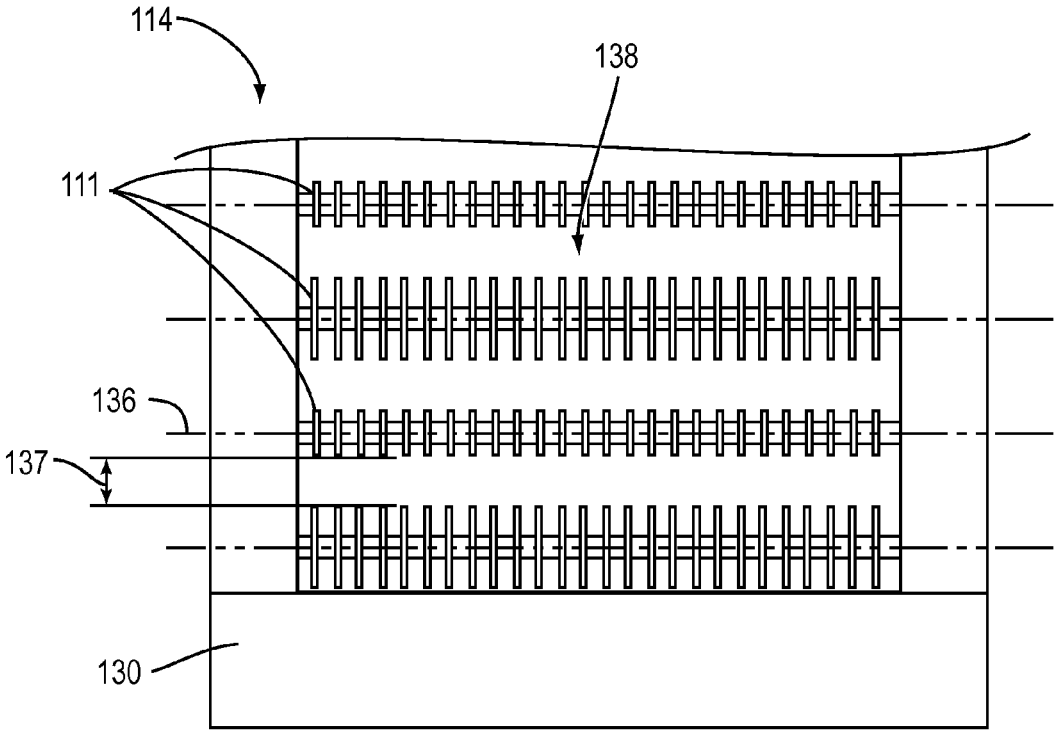
FIG. 8C is a top view of an agitator in accordance with the present invention.

With additional reference to FIG. 8C, each shaft 111 has an axis 136. A plurality of shafts 111 are coupled together within the agitator 114. The axes 136 of the plurality of shafts 111 in the agitator 114 are substantially parallel within substantially a same plane. Further, the plurality of shafts 111 of the agitator 114 are coupled adjacent each other such that the maximum axis of the plurality of scalping agitators 144 of one shaft is transverse to the maximum axis of the plurality of scalping agitators 144 of the adjacent shafts. Further, according to particular embodiments of the present invention, the plurality of scalping agitators 144 on each shaft 111 may be substantially aligned with the plurality of scalping agitators 144 of the other shafts 111. The agitator 114 further comprises a plurality of screening spaces 138 each having a predetermined spacing 137. Each spacing 137 may be defined between edges of the plurality of scalping agitators 144 of one shaft 111 and edges of the plurality of scalping agitators 144 of an adjacent shaft 111. When material is placed on a top side of the agitator 114 and is agitated by the plurality of scalping agitators 144 while the plurality of shafts 111 rotate, screening small material may occur through the plurality of screening spaces 138 while maintaining the larger material on the top side of the agitator. This allows for only material having a size smaller than the screening space 138 to pass through the agitator 114, thereby separating the smaller material from the larger material. The separation is performed by activating a motor 113 and thereby turning the shafts 111 in the same direction 160 (See FIG. 7), such that material is agitated allowing the smaller material to pass through the agitator 114 while retaining the larger material on the agitator 114. Once the material is separated, the motor 113 is deactivated thereby deactivating the agitator 114.

It will be understood that the plurality of shafts 111 may be timed such that the spacing 137 remains substantially constant during rotation of the shafts 111. This allows the agitation of the material without restricting or changing the size of the screening space 138.

Further, it will be understood that the scalping agitators 144 may be of any size and shape. For example and without limitation, the shape of the scalping agitators 144 may be round, oval, football shaped, elliptical, triangular, circular, square, rectangular, an ogive, a rounded ogive, a star, and any other shape usable within an agitator 114.

Figure 9:
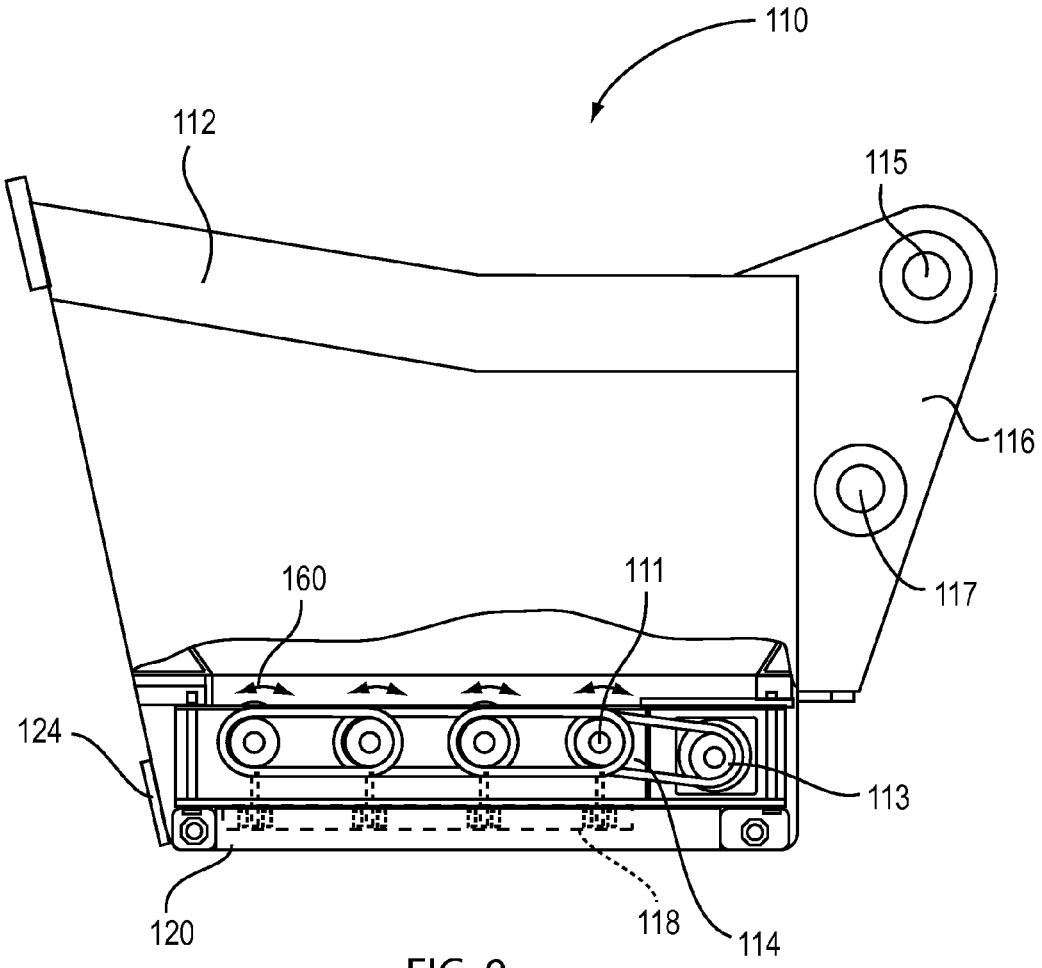
FIG. 9 is a side view of a material separator with a cut away portion of a mechanical bucket with an agitator in accordance with the present invention.

Referring to the drawings, FIG. 9 depicts a material separator 110 in accordance with particular embodiments of the present invention. The material separator 110 comprises a mechanical bucket 112, an agitator 114 and a sub-base 120. The agitator 114 is removably secured to a bottom portion 124 of the mechanical bucket 112. In particular embodiments of the present invention, the sub-base 120 is coupled to the bottom portion 124 of the mechanical bucket 112, wherein the sub-base 120 removably secures the agitator 114 to the bottom portion 124 of the mechanical bucket 112. The mechanical bucket 112 further comprises mounting ears 116. The mounting ears 116 comprise mounting apertures 115, 117 for mounting to a vehicle, such as, but not limited to, a hydraulic excavator and/or backhoe.

Particular embodiments of the material separator 110, in accordance with the present invention, may comprise a scraper 118. The scraper 118 is coupled adjacent the shafts 111 of the agitator 114. The sub-base 120 may couple the scraper 118 adjacent to the shafts 111 of the agitator 114. The scraper 118 is used to remove debris from the agitator 114.

In operation, the material separator 110 receives material within the mechanical bucket 112. The material rests on the agitator 114 without any substantial portion of the material falling through the agitator 114 when the agitator 114 is deactivated. Upon activation of the agitator 114, the agitator 114 is adapted to allow smaller material to be separated from larger material. The activation of the agitator 114 agitates the material and allows smaller material to pass through the agitator 114 while the larger material remains within the mechanical bucket 112, resting on the agitator 114.

In particular embodiments of the present invention, the material separator 110 may activate the agitator 114 at variable revolutions per minute (RPM) or at a variable rotational speed. This allows the various types of agitators 114 to be used with the material separator 110 wherein the RPM may be adjusted for reasons including, but not limited to the types of scalping agitators being used on the rollers and the material to be separated. Additionally, the agitator 114 when activated gradually reaches operating speed and when deactivated gradually reaches stopping speed. For example, the agitator 114 may be driven to its operating speed at a predetermined rate when activated and may further be driven from operating speed to a stop at a predetermined rate when deactivated. This gradual increase and decrease in speed of the agitator provides for less wear on the agitator 114, thereby prolonging the life of the agitator 114 and reducing the frequency of repairs and replacements of the agitator 114.

Figure 10A:
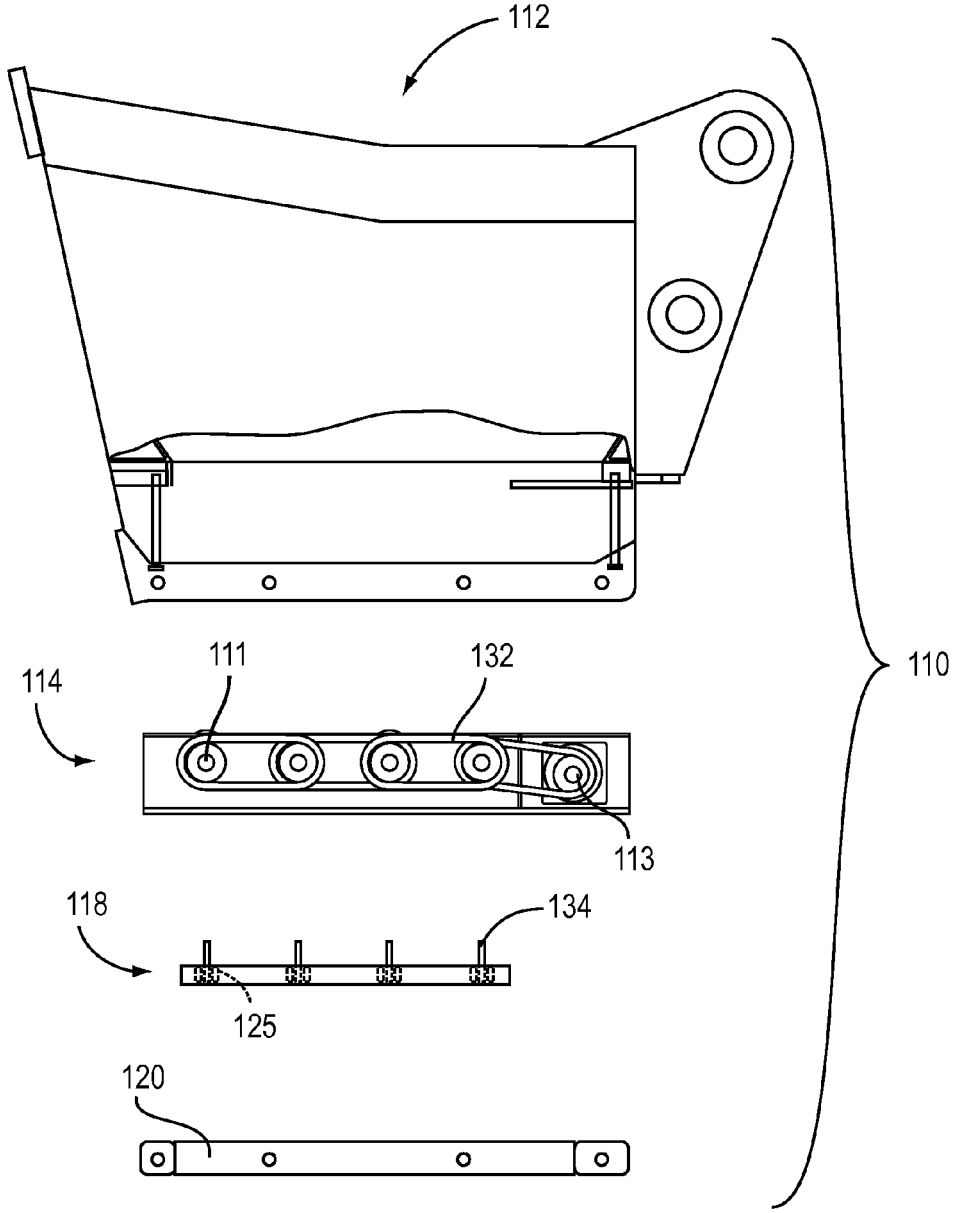
FIG. 10A is a side exploded view of the material separator of FIG. 9 in accordance with the present invention.
Figure 10B:
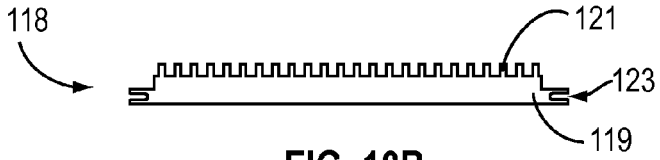
FIG. 10B is a front view of a scraper in accordance with the present invention.

Referring again to the drawings, FIGS. 10A and 10B depict an exploded view of a material separator 110 and a front view of a scraper 118 respectively. The material separator 110 in accordance with particular embodiments of the present invention comprises a mechanical bucket 112, an agitator 114, and a sub-base 120, and may comprise a scraper 118. The agitator 114 may comprise a plurality of shafts 111, a motor 113 and a plurality of chains 132 driving the agitator 114 when activated. The plurality of shafts 111 are adapted to rotate in a same direction 160 (See FIG. 7) when the agitator 114 is activated by the motor 113 and chains 132. The motor 113 may be adapted to gradually bring the agitator 114 to operating speed upon activation and to gradually bring the agitator 114 to a stop upon deactivation. Further, the motor 113 may operate the agitator 114 at variable revolutions per minute.

The scraper 118 may comprise a plurality of scrapers 134, wherein the number of scrapers 134 corresponds to the number of shafts 111. A scraper 118 comprises a base portion 119 and a plurality of extensions 121. The extensions 121 extend in a direction transverse to the base portion 119. The plurality of extensions 121 engage the agitator 114 to scrape debris from the agitator 114. According to particular embodiments, the extensions 121 engage the cleaning areas 141 between the plurality of scalping agitators 144 of each shaft 111 to automatically scrape debris from each shaft 111 as the shaft 111 rotates. It will be understood by those of ordinary skill in the art that various types of scraper devices may be employed, so long as they remove debris from the agitator. Further, the base portion 119 further comprises notches 123 that are used to couple the scraper 118 to the agitator 114 by use of brackets 125. The notches 123 allow the scraper 118 to be forcibly removed from the agitator 114 if the scraper 118 has a force applied to it that causes the scraper 118 to bend. This allows the scraper 118 to be removed from the agitator 114 without causing additional damage to the agitator 114.

Figure 11A:
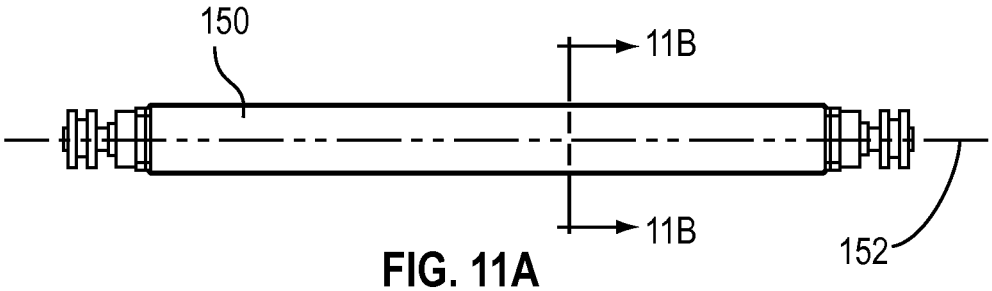
FIG. 11A is a side view of a solid shaft configuration of an agitator in accordance with the present invention.
Figure 11B:
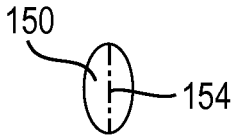
FIG. 11B is a section view taken along lines 11B-11B of FIG. 11A of a solid shaft configuration of an agitator in accordance with the present invention.
Figure 11C:
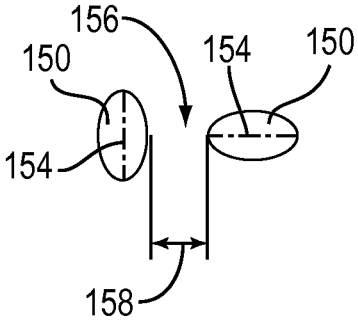
FIG. 11C is a section view of two shafts of an agitator in accordance with the present invention.
Figure 12:
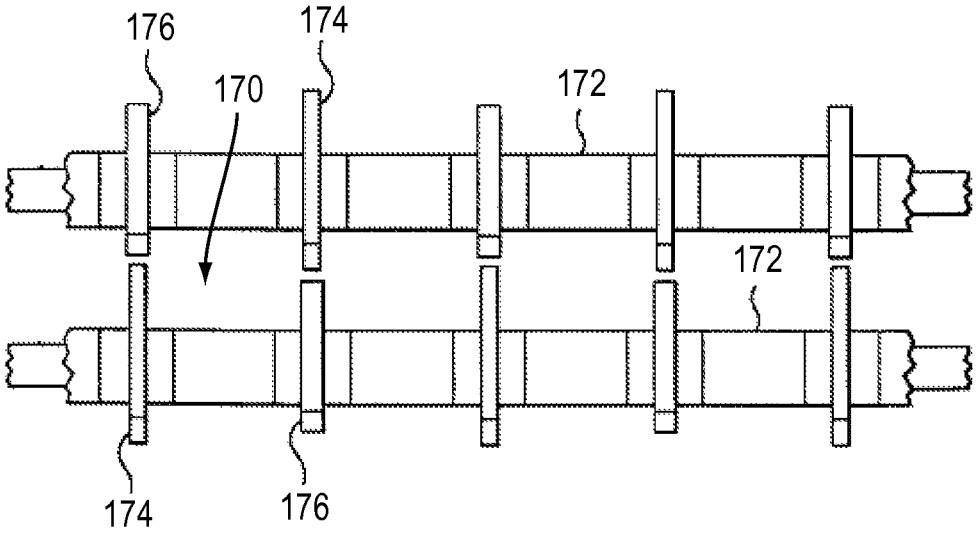
Prior Art FIG. 12
FIG. 12 is a prior art roller screen configuration.

Referring again to the drawings, FIGS. 11A-11C depict another type of solid shaft 150 for use in an agitator in accordance with particular embodiments of the present invention. The agitator has the same parts as that shown in FIGS. 7-8C; however, the shafts 111 are replaced with the solid shafts 150. The solid shafts 150 may have an axis 152. When coupled within an agitator and with reference to FIG. 11C, a plurality of solid shafts 150 may be coupled together such that the axis 152 of each shaft is substantially parallel and substantially within the same plane. The solid shafts 150 are spaced apart to create a plurality of screening spaces 156 having a predetermined spacing 158. Each spacing 158 may be defined between an edge of one solid shaft 150 and an edge of an adjacent solid shaft 150. The plurality of solid shafts 150 may have timing such that the spacing 158 of the plurality of screening spaces 156 is constant during rotation of the plurality of shafts. Timing of the rotation of the plurality of solid shafts 111 may be governed by an orientation of the plurality of solid shafts 111. For example and without limitation, in cross-section, the solid shafts 150 may be elliptical in shape having a maximum axis 154. The solid shafts 150 may be oriented such that the maximum axis 154 of one shaft 150 is transverse to the maximum axis 154 of an adjacent solid shaft 150.

When material is placed on a top side of the agitator and is agitated by the rotation of the plurality of solid shafts 150, screening small material may occur through the plurality of screening spaces 156 while maintaining the larger material on the top side of the agitator. This allows for only material having a size smaller than the screening space 156 to pass through the agitator, thereby separating the smaller material from the larger material.

It will be understood that the plurality of solid shafts 150 may be timed such that the spacing 158 remains substantially constant during rotation of the solid shafts 150. This allows the agitation of the material without restricting or changing the size of the screening space 156.

Other particular embodiments of the present invention comprise a method of using a mechanical bucket for separating smaller material from larger material. The method comprises the steps of receiving material within a mechanical bucket, the material including smaller material and larger material and moving the mechanical bucket to a location for depositing the smaller material. The method further comprises the steps of activating an agitator of the mechanical bucket to separate the smaller material from the larger material and depositing the smaller material in the location, wherein the smaller material during separation passes through the agitator and is deposited in the location.

In particular embodiments, the method further comprises the steps of agitating the material to facilitate separation of the smaller material from the larger material and retaining the larger material within the mechanical bucket. The method also comprises the step of deactivating the agitator when separation of the smaller material from the larger material is completed. Additionally, the method may also comprise the steps of moving the mechanical bucket to a second location and dumping the larger material in the second location.

It will be understood that other various steps may comprise, attaching the mechanical bucket to a vehicle, removing the agitator from the mechanical bucket, securing the agitator to the bucket using a sub-base, and scraping debris from the agitator by use of a scraper device.

Figure 13A:
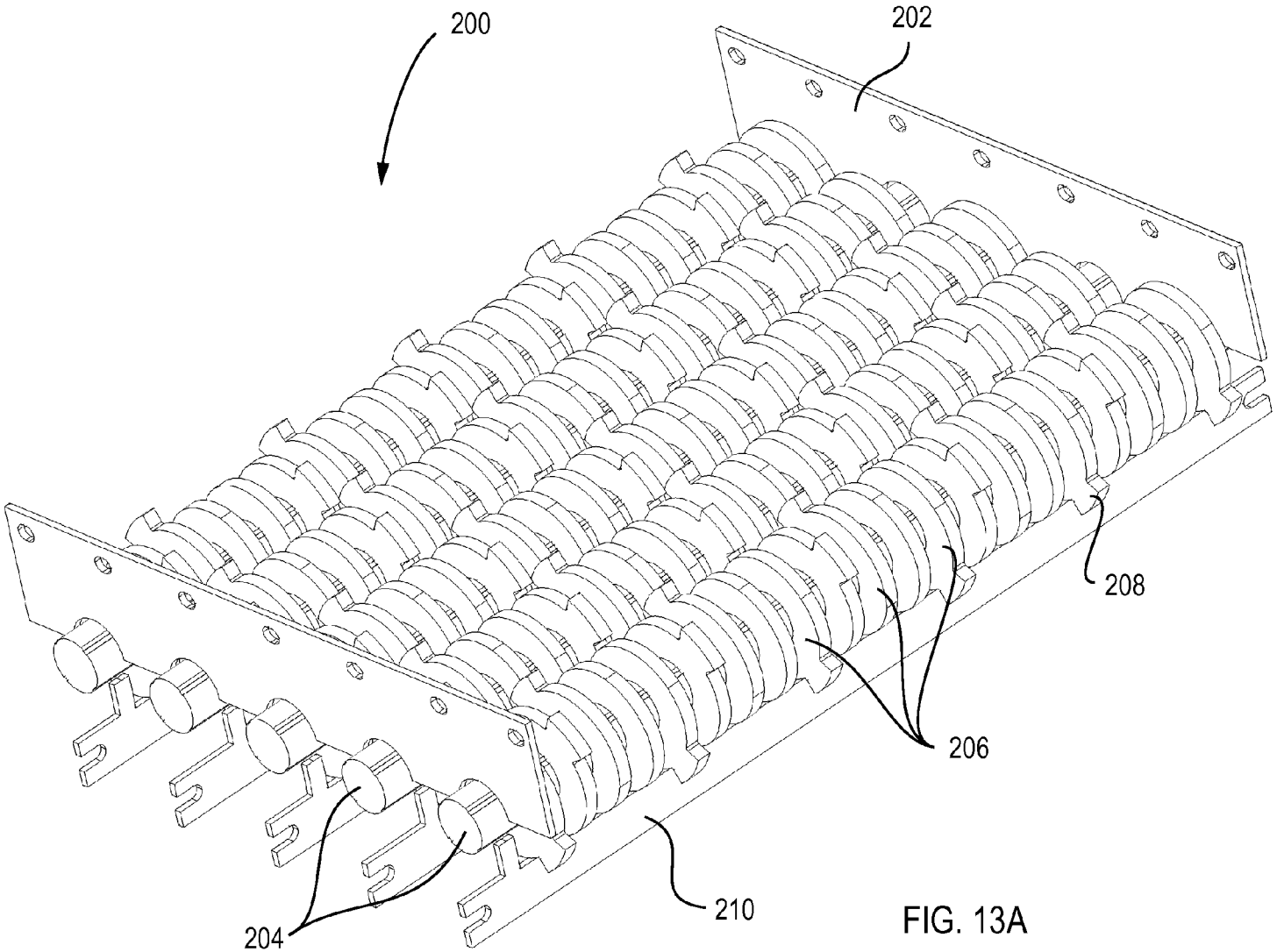
FIGS. 13A and 13B are perspective views of a motor driven crusher.
Figure 13B:
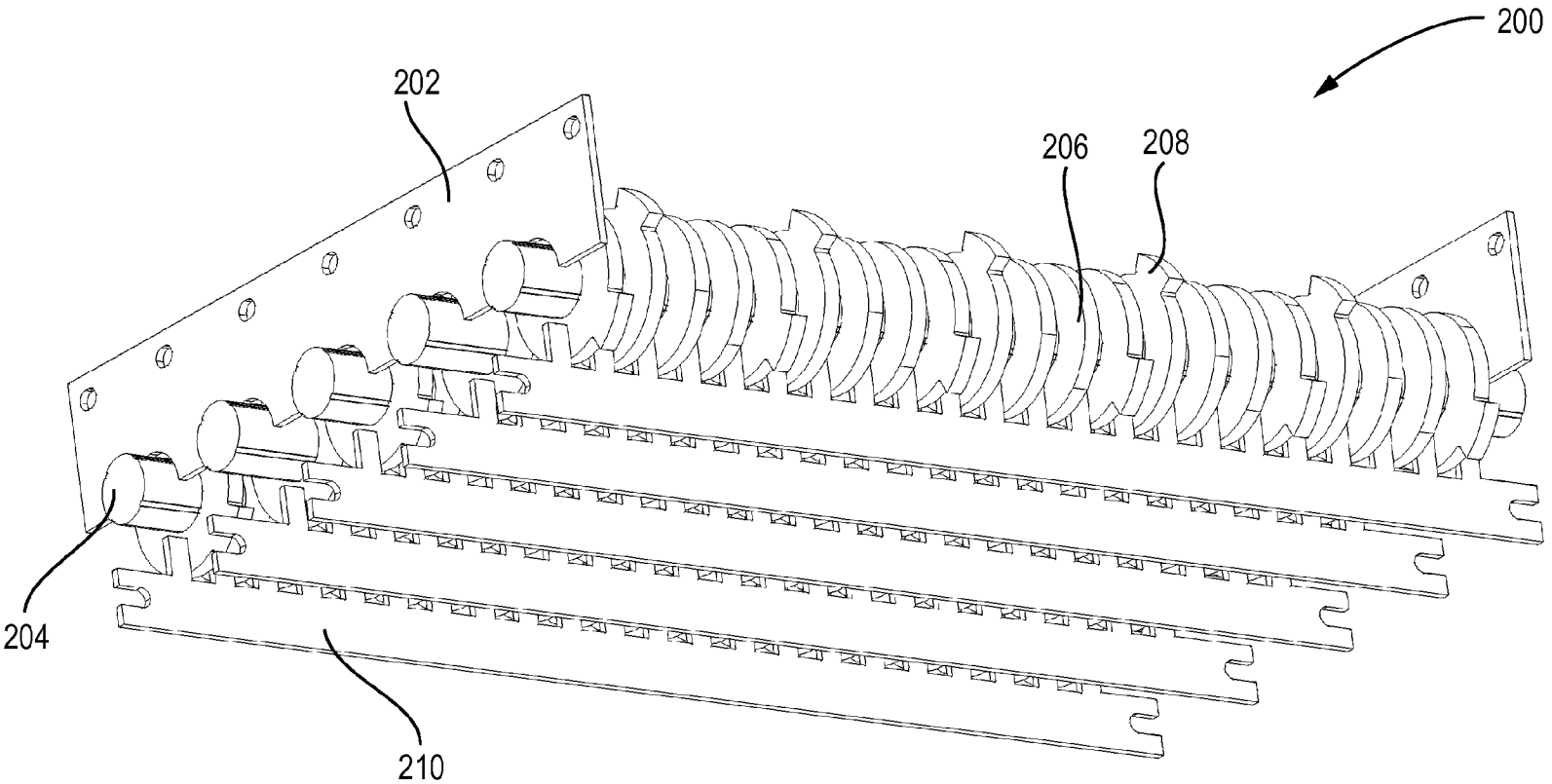

Other embodiments of the present invention include a motor driven crusher 200 as shown in FIGS. 13A-16. Referring to FIGS. 13A and 13B, a crusher 200 includes a frame 202, a plurality of shafts 204, and a plurality of crushing agitators 206 coupled to each shaft 204. The crushing agitators 206 may further include a protrusion 208. The crusher also includes a scraper 210.

Figure 14:
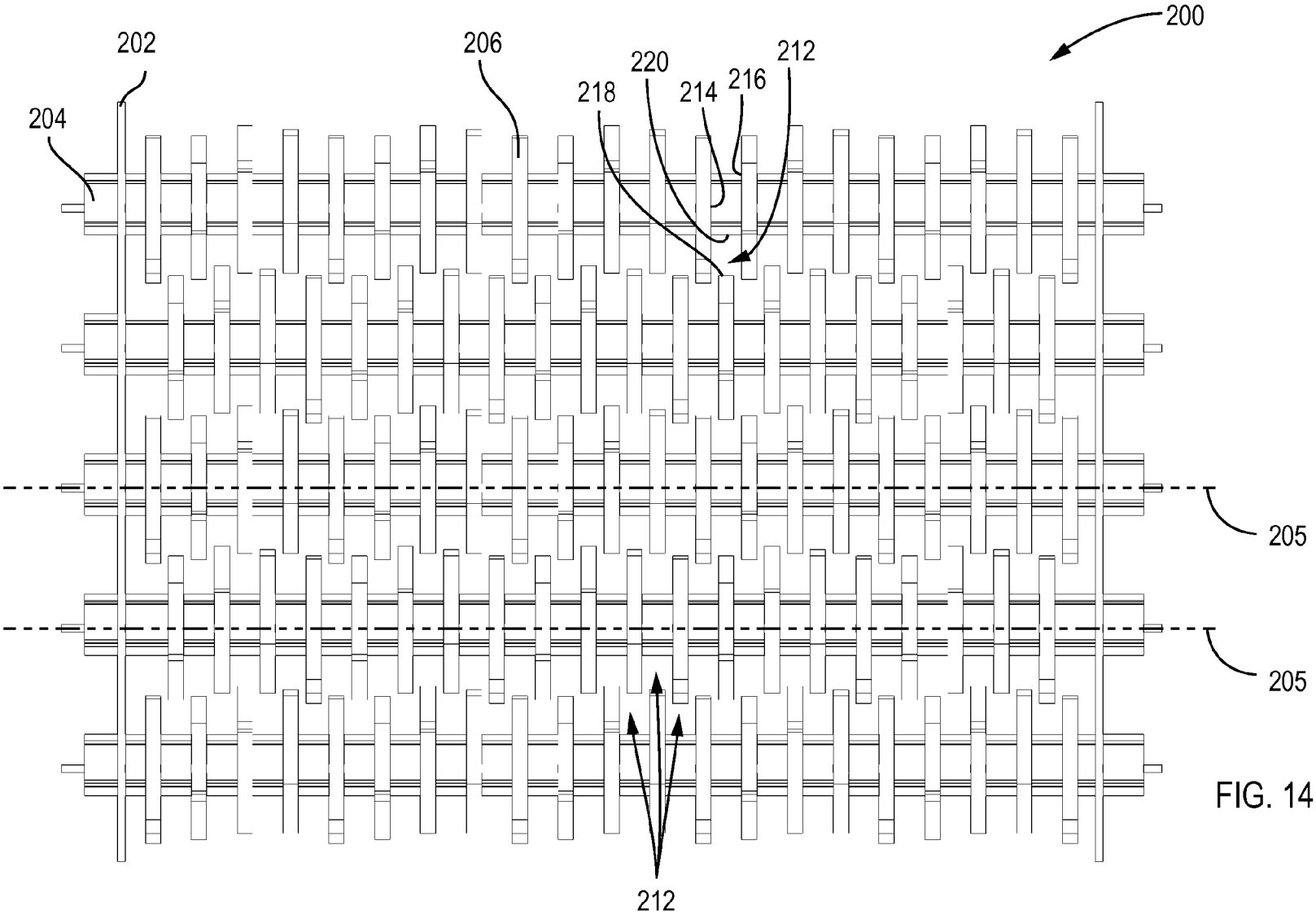
FIG. 14 is a top view of a crusher.

As shown in FIG. 14, each shaft 204 has an axis 205. A plurality of shafts 204 are coupled together within the crusher 200. The axes 205 of the plurality of shafts 204 in the crusher 205 are substantially parallel within substantially a same plane. Further, the plurality of shafts 204 of the crusher 200 are coupled adjacent each other such that the plurality of crushing agitators 206 of one shaft is interlaces with the plurality of crushing agitators 206 of the adjacent shafts 204. The crusher 200 further comprises a plurality of screening spaces 212 each having a predetermined spacing. Each spacing of the plurality of screening spaces 212 may be defined between sides 214 and 216 of adjacent crushing agitators 206 of one shaft 205, an edge 220 of the one shaft 205 and an edge 218 of a crushing agitator 206 of an adjacent shaft 204, wherein material placed on a top side of the crusher 200 is agitated and crushed by the plurality of crushing agitators 206 while the plurality of shafts 205 rotate, screening small material through the plurality of screening spaces 212 while crushing the larger material on the top side of the crusher 200 to fit within the plurality of screening spaces 212.

Referring still to FIG. 14, when material is placed on a top side of the crusher 200 and is agitated by the plurality of crushing agitators 206 while the plurality of shafts 204 rotate, small material is screened through the plurality of screening spaces 212 while maintaining the larger material on the top side of the crusher 200. This allows for only material having a size smaller than the screening space 212 to pass through the crusher 200. The larger material on the top side of the crusher 200 is then crushed, wherein the material is broken into pieces having a size to fit within the plurality of screening spaces 212. Accordingly, the crusher 200 agitates and crushes material on the top side of the crusher 200 in response to activation of the crusher 200.

Figure 15:
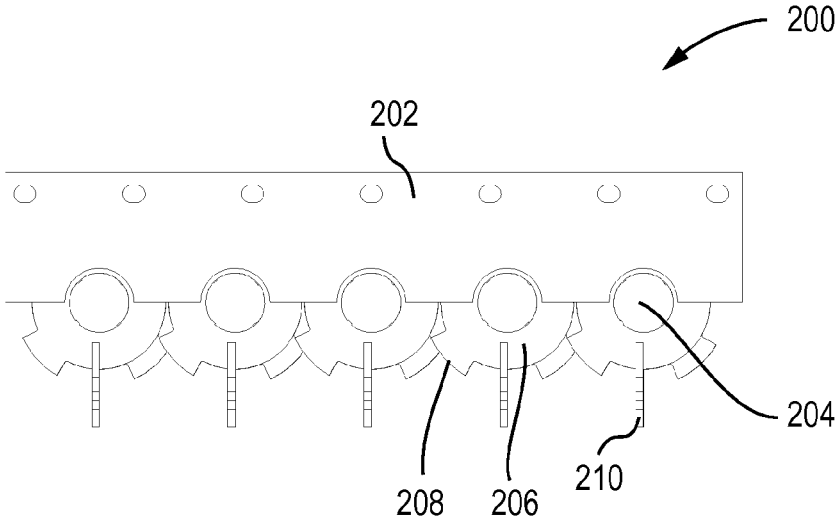
FIG. 15 is a side view of a crusher.
Figure 16:
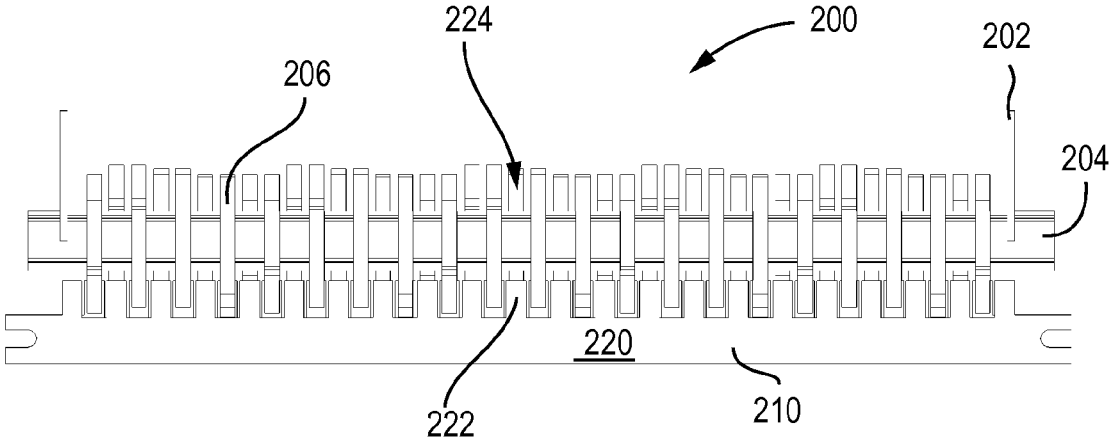
FIG. 16 is an end view of a crusher.

Referring to FIGS. 15 and 16, the scraper 210 is coupled to a bottom side of the crusher 200. The scraper 210 removes debris from the crusher 200. The scraper 210 comprises a base portion 220 and a plurality of extensions 222 that extend in a direction transverse to the base portion 220, the extensions 222 engaging an area 224 between the plurality of crushing agitators 206 of each shaft 204 to automatically scrape debris from each shaft 204. As can be seen from FIGS. 15 and 16, embodiments include a plurality of scrapers 210, wherein the number of scrapers 210 corresponds to the number of shafts 204 in the crusher 200. In these embodiments, each scraper 210 is aligned with an axis of a shaft 204. The scrapers 210 provide a third function of the crusher 200, wherein the crusher agitates material allowing small material to move through screening spaces 212, crush larger material into particle sizes smaller than the screening spaces 212, and cleaning any debris build up on the shafts 204, such as mud, dirt and the like.

The crusher 200 is driven to its operating speed at a first predetermined rate when activated. The crusher 200 is driven to a stop from operating speed at a second predetermined rate when deactivated. The crusher 200 operates at a variable rotational speed.

Figure 17:
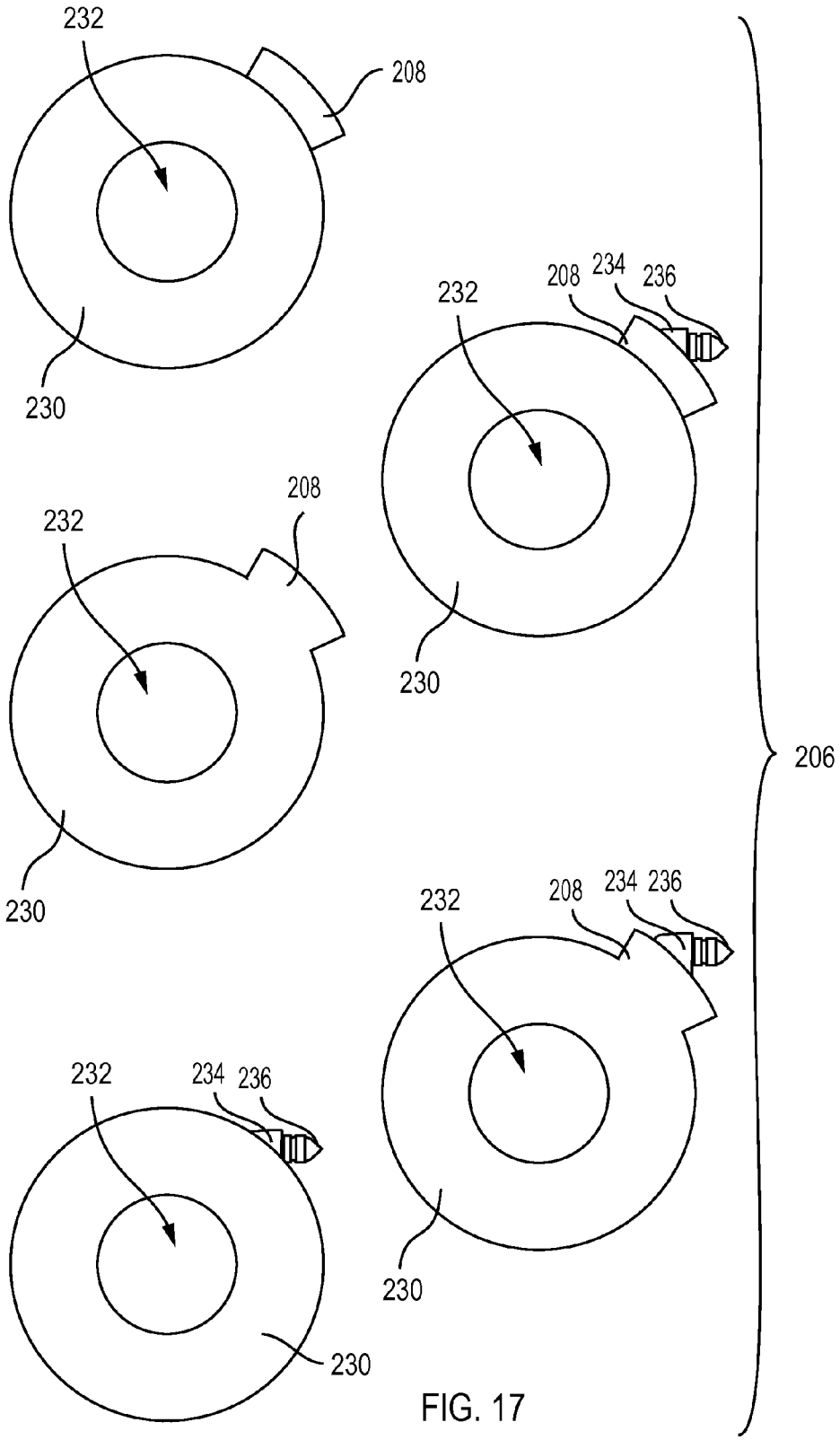
FIG. 17 is a side view of various configurations of crushing agitators.

Referring to the drawings further, FIG. 17 depicts crushing agitators 206. Each crushing agitator 206 includes a disc portion 230 and a disc aperture 232, wherein the disc aperture 232 receives a shaft 204 therethrough and couples the disc portion 230 to the shaft 204. Each crushing agitator 206 comprises a protrusion 208, wherein the protrusion 208 crushes material in response to rotation of the shafts 204.

FIG. 17 further depicts various configurations of the protrusion 208. In particular embodiments the protrusion 208 may be a hammer 208, a cutting device 236 coupled to a base 234, or a combination of a hammer with a cutting device. As can be seen, the protrusion may be coupled to the disc portion 230 or be integral with the disc portion 230. It may be coupled by welding, fasteners, adhesives and the like. Further the hammer 208 and the cutting device 236 with a base 234 may be formed of any type of hard material, such as, but not limited to, steel, carbide, alloys and the like. The cutting device 236 may also be a cutting tooth.

Referring further to FIGS. 13A-16 the crushing agitators 206 are coupled to the shaft 204 with the protrusions 208 of each crushing agitator 206 located at a different arc degree from protrusions 208 of adjacent crushing agitators 206. In particular embodiments, the protrusions 208 are located at an equal arc degree from other protrusions 208. For example, without limitation, the protrusions 208 of adjacent crushing agitators 206 may be located at 90 degrees rotation from the adjacent crushing agitators 206, thereby creating a type of helical configuration of protrusions 208. The protrusions 208 of the crushing agitators 206 crush material between the protrusion 208 and adjacent shafts 204 and crushing agitators 206. The location of the protrusions 208 increases agitation of the material on the crusher 200.

The crusher 200 is attached to a mechanical bucket by use of a sub-base 120 shown in FIG. 7. This base and sub-base 120 secure the crusher 200 including the scrapers 210 to the mechanical bucket in the same way that the sub-base 120 secures the agitator to the mechanical bucket. This allows the crusher 200 to operate with material collected by the bucket.

Further, the mechanical bucket with the crusher 200 further utilizes the same motor 113 and chains 132 as shown in FIG. 7 to drive the crusher 200 and turn the shafts 204. Further the mechanical bucket with the crusher 200 may further be coupled to an excavator as shown in FIG. 6, thereby creating a material agitating and crushing apparatus. The apparatus includes an excavator including a mechanical bucket comprising a motor driven crusher 200, the motor driven crusher 200 comprising a frame 202 removably coupled to a mechanical bucket. The crusher 200 further includes a plurality of shafts 204 rotatably coupled within the frame 202 and operationally coupled to the motor, wherein axes of the plurality of shafts 204 are substantially parallel. The plurality of crushing agitators 206 coupled to each shaft 204 of the plurality of shafts 204. Further, a plurality of screening spaces 212 each have a predetermined spacing, each spacing of the plurality of screening spaces defined between sides of adjacent crushing agitators 206 of one shaft 204, an edge of the one shaft 204 and an edge of a crushing agitator 206 of an adjacent shaft 204, wherein material placed on a top side of the crusher 200 is agitated and crushed by the plurality of crushing agitators 206 while the plurality of shafts 204 rotate, screening small material through the plurality of screening spaces 212 while crushing the larger material on the top side of the crusher 200 to fit within the plurality of screening spaces 212.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A motor driven crusher for crushing material, the crusher comprising:

a bucket;

a plurality of shafts removably and rotatably coupled to the bucket and operationally coupled to the motor, wherein axes of the plurality of shafts are substantially parallel;

a sub-base removably securing the plurality of shafts within the bucket, wherein the sub-base is coupled to a bottom portion of the bucket below the plurality of shafts;

a plurality of crushing agitators coupled to each shaft of the plurality of shafts, wherein the crushing agitators each comprise a protrusion; and a plurality of screening spaces each having a predetermined spacing, wherein material placed on a top side of the crusher is agitated and crushed by the protrusions of the plurality of crushing agitators in response to rotation of the plurality of shafts, screening small material through the plurality of screening spaces while crushing the larger material on the top side of the crusher to fit within the plurality of screening spaces.

2. The crusher of claim 1, further comprising a scraper coupled to a bottom side of the crusher, wherein the scraper removes debris from the crusher.

3. The crusher of claim 2, wherein the scraper comprises a base portion and a plurality of extensions that extend in a direction transverse to the base portion, the extensions engaging an area between the plurality of crushing agitators of each shaft to automatically scrape debris from each shaft.

4. The crusher of claim 1, wherein the crusher agitates and crushes material on the top side of the crusher in response to activation of the crusher.

5. The crusher of claim 4, wherein the crusher is driven to its operating speed at a first predetermined rate when activated.

6. The crusher of claim 5, wherein the crusher is driven to a stop from operating speed at a second predetermined rate when deactivated.

7. The crusher of claim 6, wherein the crusher when activated operates at a variable rotational speed.

8. The crusher of claim 1, wherein the crushing agitators are coupled to the shaft with the protrusions of each crushing agitator located at a different arc degree from protrusions of adjacent crushing agitators.

9. The crusher of claim 8, wherein the protrusions of the crushing agitators crush material between the protrusion and adjacent shafts and crushing agitators.

10. The crusher of claim 9, wherein the location of the protrusions increases agitation of the material on the crusher.

11. The crusher of claim 8, wherein the protrusion is one of a hammer, a tooth or combinations thereof.

* * * * *